United States Patent [19]

Schmauder et al.

[11] 3,939,378

[45] Feb. 17, 1976

[54] STORAGE CATHODE RAY TUBE HAVING AUXILIARY COILS TO CORRECT NON-SYMMETRICAL GEOMETRY

[75] Inventors: Johnnie Everett Schmauder, Portland; James Kipling Richardson, Beaverton, both of Oreg.

[73] Assignee: Tektronix, Inc., Beaverton, Oreg.

[22] Filed: Jan. 8, 1975

[21] Appl. No.: 539,563

Related U.S. Application Data

[63] Continuation of Ser. No. 388,857, Aug. 8, 1973, abandoned.

[52] U.S. Cl. ..... 315/12 R; 313/437; 313/396

[51] Int. Cl.[2] ..... H01J 31/60; H01J 31/58

[58] Field of Search ..... 315/12; 313/437

[56] References Cited

UNITED STATES PATENTS

| | | | |
|---|---|---|---|
| 2,164,906 | 7/1939 | Deserno et al. | 315/8 |
| 2,258,643 | 10/1941 | De Gier et al. | 313/43 |
| 2,387,608 | 10/1945 | Paumier | 315/8 |
| 2,927,239 | 3/1960 | Hunter | 313/115 |
| 3,131,324 | 4/1964 | Madden et al. | 313/395 |
| 3,179,833 | 4/1965 | Callick et al. | 313/396 |
| 3,325,673 | 6/1967 | Anderson | 315/12 |
| 3,340,443 | 9/1967 | Rieth et al. | 317/157.5 |
| 3,449,621 | 6/1969 | Himmelbauer et al. | 315/394 |

*Primary Examiner*—Robert Segal
*Attorney, Agent, or Firm*—Adrian J. LaRue

[57] ABSTRACT

A storage cathode-ray-tube having a single off-axis flood gun is described including auxiliary coils defining electromagnets placed, one electromagnet on either side of the cathode-ray-tube to correct non-symmetrical geometry in optical representations produced on the fluorescent screen of the cathode-ray tube caused by interaction of the conventional principle electron beam under the control of electrical signals during storage operation.

1 Claim, 8 Drawing Figures

STORAGE CATHODE RAY TUBE HAVING AUXILIARY COILS TO CORRECT NON-SYMMETRICAL GEOMETRY

CROSS REFERENCE TO RELATED APPLICATION

This is a continuation of Ser. No. 388,857, filed Aug. 8, 1973, now abandoned.

BACKGROUND OF THE INVENTION

Heretofore, no storage cathode-ray-tube having therein a single on axis writing gun to provide the principle electron beam and a single off-axis flood gun to provide the flood electron beam so as to write and store an image on the fluorescent screen of the cathode-ray-tube has been provided because of non-symmetrical geometry in optical representations caused by electron-electron interaction of the flood and writing electron beams under the control of electrical signals during storage operation.

Distortions, as described above, to the image produced on the fluorescent screen due to electron-electron interaction are well known. For example, in single gun cathode-ray-tubes using electrostatic deflecting devices, one cause of such distortions are the effects of a non-uniform electric field between one of the pairs of deflecting plates.

To eliminate the distortions in single gun cathode-ray-tubes conventional arrangements including magnet poles arranged adjacent the point of impact of the electron beam remote from the point of deflection have been used.

In storage cathode-ray-tubes, the distortions are eliminated by providing within such tubes two flood guns and operated in a conventional manner. Another conventional means to eliminate such distortions which is applicable to both single gun cathode-ray-tubes and storage cathode-ray tubes having a plurality of electron guns is by varying the voltage on a wallband electrode coated on the inner surface of the tube envelope and positioned between the output ends of the deflection means and the fluorescent screen.

However, the above described means to correct the non-symmetrical geometry in optical representations are not effective when using a on axis single writing gun and a single off-axis flood gun due to the fact that compensation occurs at all times, hence, would cause further distortions. For example, if the magnet pole correction means were used as disclosed in U.S. Pat. No. 2,258,643 and were applicable to storage cathode-ray-tubes, it would be necessary to remove such magnets during storage operation to prevent interaction of the field produced by such magnet poles and the flood electron beam during storage operation. To remove these means during storage operation would be impractical, if not impossible.

SUMMARY OF INVENTION

The present invention overcomes the disadvantages of the prior art and provides a storage-cathode-ray tube having a single writing electron gun and a single off-axis flood electron gun operably connected to means to correct for non-symmetrical geometry in optical representations caused by electron-electron interaction of the flood and writing electron beams under the control of electric signals during storage operation. Auxiliary coils defining electromagnets, one electromagnet on either side of the storage cathode-ray-tube, placed between the deflection plates and fluorescent screen external to the cathode-ray-tube envelope provide during storage operation, a non-uniform magnetic field directly proportional to the flood gun beam current which compensates for the above discussed distortions.

It is therefore an object of the present invention to provide a storage cathode-ray-tube having a single writing electron gun and a single off-axis flood electron gun having means to correct non-symmetrical geometry in optical representations.

It is another object of the present invention to provide a means for eliminating geometry distortion in an optical representation under the control of electrical signals.

It is yet another object of the present invention to provide a storage cathode-ray-tube having non-symmetrical geometry correction means which is simple and inexpensive to manufacture.

It is still another object of the present inventicn to provide a storage cathode-ray-tube having non-symmetrical geometry correction means requiring minimum power usage.

Additional objects and advantages of the present invention may be apparent from the following detailed description of the present invention shown in the accompanying drawings wherein like characters refer to like elements.

DESCRIPTION OF INVENTION

Figure 1A:
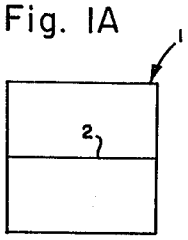
FIGS. 1A and 1B are front and side view of a conventional cathode-ray-tube having a single electron beam gun.
Figure 1B:
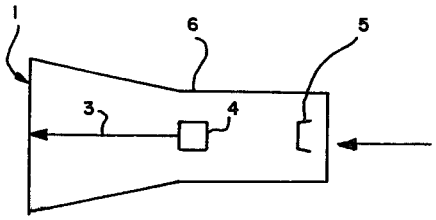
Figure 2A:
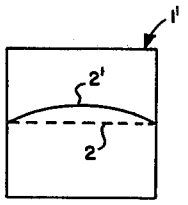
FIGS. 2A and 2B are front and side views of a storage cathode-ray-tube having a single writing electron beam gun and a single off-axis flood electron beam gun.
Figure 2B:
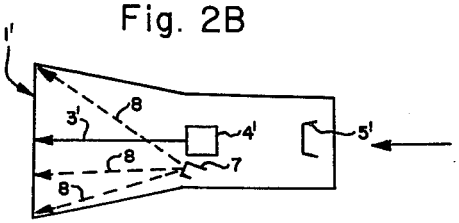

Referring to the drawings and in particular to FIGS. 1 and 2, there is shown two embodiments to describe non-symmetrical geometry. FIG. 1 shows a front and side view of a conventional cathode-ray-tube having a single electron gun. A conventional faceplate 1 displays the normal horizontally deflected writing gun trace 2 as a light image by horizontally deflecting an electron beam 3 by deflection means 4 disposed between a writing electron gun 5 and the faceplate. Cathode-ray-tube envelope 6 completely encloses the deflection means and electron gun as is well-known. Although not shown, means to control the writing beam electrons 3 and the deflection means 4 are employed. Further, writing gun trace 2 is shown horizontal for purposes of clarity and can be deflected vertically by applying a vertical deflection signal to vertical deflection means and geometrically corrected in a conventional manner. As can be discerned from the drawing of FIG. 1 distortionless deflection occurs such as in the already discussed U.S. Patent.

Shown in FIG. 2 is a storage cathode-ray-tube having therein, in addition to the elements referred to in the drawing of FIG. 1, a flood electron beam gun 7. The faceplate 1′ includes a storage target. The flood gun during storage operation, emits a plurality of low volocity flood electron beams 8 which uniformly bombard the storage target to hold or retain the image written on the storage target by bombarding the target with high velocity electrons comprising the electron beam 3′, such image being the writing gun trace 2′. As can be discerned from the drawing and which is well-known to those skilled in the art, the trace 2′ has been distorted due to interaction of the flood electron beams 8 and electron beam 3 when the flood gun 7 is turned on (see "Storage Cathode-Ray-Tubes and Circuits", Circuit Concepts, Tektronix, Inc. for interactions due to simultaneous operation of flood and writing guns); thus, non-symmetrical geometry in optical representations.

Figure 3A:
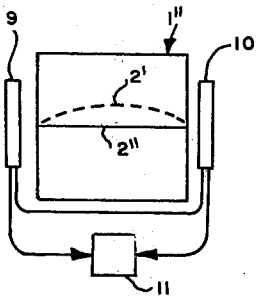
FIGS. 3A and 3B are front and side views of a storage cathode-ray-tube having a single writing electron beam gun and a single off-axis flood electron beam gun including means to correct for distortions according to the present invention.
Figure 3B:
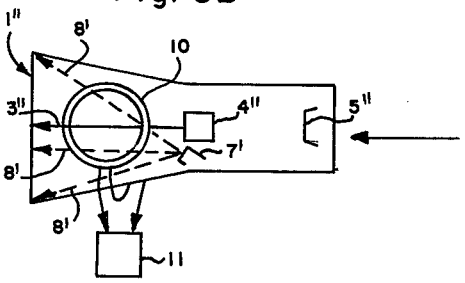

Referring now to FIG. 3 and more particularly to FIG. 3A, there is shown a storage cathode-ray-tube identical to the storage cathode-ray-tube of FIG. 2 but including means to correct for the non-symmetrical distortion according to the present invention. Auxiliary circular shaped coils 9 and 10 have been placed beside, one on either side, the cathode-ray-tube approximately midway between flood electron gun 7′ and faceplate 1″. Such auxiliary coils are well-known in the art as Helmholtz coils and are fully described on pages 59–62 of "Fundamentals of Electricity and Magnetism" by Leonard B. Loeb; third edition, Dover Publications, Inc., New York. Auxiliary coils 9 and 10 are connected to a current source 11. Although shown as a separate current source, current source 11 in the preferred embodiment is connected so that when operated in the storage mode all flood gun beam current must flow through coils 9 and 10 thereby making the correcting field developed by such coils proportional to the flood beam current.

Figure 4A:
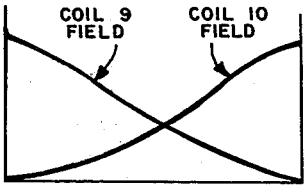
FIGS. 4A and 4B are plots of the fields generated by a set of Helmholtz coils.
Figure 4B:
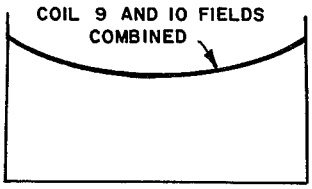

To understand operation of the means to correct for non-symmetrical geometry, reference should be made to FIG. 4. Shown in FIG. 4A is the field produced by auxiliary coils 9 and 10 when a DC current is sent through such coils and FIG. 4B is the resultant field intensity plot of the Helmholtz coils. By applying this resultant field intensity produced by the Helmholtz to the cathode-ray-tube of FIG. 3, the distorted writing beam trace 2′ will return to the position of writing beam trace 2″. This technique straightens the deflected writing beam and compensates for the non-symmetrical geometry.

It should be noted that the two forces acting on the deflected writing beam may result in a slight change in the vertical position of the trace. This can easily be compensated for electronically as is well-known.

Thus, use of a non-uniform magnetic field to correct a geometry problem in a storage cathode-ray-tube due to non-symmetrical distribution of flood electrons is a new and unique solution allowing the use of storage cathode-ray-tubes having flood gun configurations that would otherwise yield unacceptable geometry appearance of the written optical representation.

While there has been shown and described the preferred embodiment of the present invention, it will now be apparent to those skilled in the art that many changes and modifications may be made without departing therefrom in its broader aspects. Therefore, the appended claim is intended to cover all such modifications and changes as fall within the true spirit and scope of this invention.

The invention is claimed in accordance with the following:

1. A storage cathode-ray-tube having auxiliary coils to correct non-symmetrical geometry of an image caused by electron-electron interaction of writing and storing electron beams, comprising:

faceplate means including a storage target for providing an image producing means;

means for bombarding said faceplate means with high velocity electrons emitted from a single on axis writing electron gun to produce an image on said storage target;

means for simultaneously bombarding said faceplate means with uniformly distributed flood beam electrons emitted from a single off axis flood electron gun to retain said image; and an auxiliary set of "Hemholtz" coils disposed between said faceplate means and said flood electron gun and on opposite sides of the cathode-ray-tube, said coils connected to receive said flood beam electrons for producing a correcting field proportional to said flood beam electrons for compensating the electron-electron interaction thereby substantially eliminating non-symmetrical geometry of the image.

* * * * *